US009012388B2

(12) United States Patent
Loeffler et al.

(10) Patent No.: US 9,012,388 B2
(45) Date of Patent: Apr. 21, 2015

(54) GEL SURFACTANT COMPOSITION

(75) Inventors: Matthias Loeffler, Idstein (DE); Ernesto Iwao Horikoshi, Riehen (CH); Gustavo Haruki Kume, Sao Paulo-SP (BR); Ana Regina Coimbra, Sao Paulo-SP (BR); Karine Lima Goncalves Framesqui, Sao Paulo-SP (BR); Manlio Gallotti, Sao Paulo-SP (BR); George Italo Pitombeira Nunes, Huntersville, NC (US)

(73) Assignees: Clariant Finance (BVI) Limited, Tortola (VG); Clariant S.A., Sao Paulo (BR)

( * ) Notice: Subject to any disclaimer, the term of this patent is extended or adjusted under 35 U.S.C. 154(b) by 15 days.

(21) Appl. No.: 13/059,450

(22) PCT Filed: Aug. 28, 2009

(86) PCT No.: PCT/EP2009/006266

§ 371 (c)(1),
(2), (4) Date: Feb. 17, 2011

(87) PCT Pub. No.: WO2010/022975

PCT Pub. Date: Mar. 4, 2010

(65) Prior Publication Data

US 2011/0152154 A1 Jun. 23, 2011

(30) Foreign Application Priority Data

Aug. 30, 2008 (EP) ..... 08015368
Aug. 28, 2009 (WO) ..... PCT/EP2009/006266

(51) Int. Cl.

| | |
|---|---|
| ***C11D 3/48*** | (2006.01) |
| ***C11D 1/835*** | (2006.01) |
| ***C11D 1/94*** | (2006.01) |
| ***C11D 17/00*** | (2006.01) |
| *C11D 1/62* | (2006.01) |
| *C11D 1/72* | (2006.01) |

(52) U.S. Cl.
CPC *C11D 1/835* (2013.01); *C11D 1/62* (2013.01); *C11D 1/72* (2013.01); *C11D 1/94* (2013.01); *C11D 17/003* (2013.01)

(58) Field of Classification Search
USPC ..... 510/218, 336, 403, 515
See application file for complete search history.

(56) References Cited

U.S. PATENT DOCUMENTS

| | | | | |
|---|---|---|---|---|
| 3,935,130 | A * | 1/1976 | Hirano et al. | 510/238 |
| 4,220,562 | A | 9/1980 | McRitchie et al. | |
| 4,351,737 | A | 9/1982 | Billenstein et al. | |
| 5,177,256 | A * | 1/1993 | Kubo et al. | 562/107 |
| 5,269,974 | A * | 12/1993 | Ofosu-Asante | 510/237 |
| 5,985,813 | A * | 11/1999 | Arvanitidou | 510/237 |
| 6,362,142 | B1 | 3/2002 | Weber et al. | |
| 6,689,223 | B1 * | 2/2004 | Meine et al. | 134/2 |
| 6,897,187 | B2 * | 5/2005 | Gallotti et al. | 510/237 |
| 7,074,753 | B2 * | 7/2006 | Gallotti et al. | 510/496 |
| 2001/0025020 | A1 | 9/2001 | Holderbaum et al. | |
| 2004/0023832 | A1 * | 2/2004 | Gallotti et al. | 510/391 |
| 2006/0172912 | A1 * | 8/2006 | Burt et al. | 510/383 |

FOREIGN PATENT DOCUMENTS

| | | |
|---|---|---|
| EP | 0048163 | 3/1982 |
| EP | 1162254 | 12/2001 |
| EP | 1426354 | 6/2004 |
| GB | 2122662 | 1/1984 |
| WO | WO 99/24549 | 5/1999 |
| WO | WO 01/42416 | 6/2001 |
| WO | WO 2004/020560 | 3/2004 |

OTHER PUBLICATIONS

International Search Report for PCT/EP2009/006266 dated Mar. 4, 2010.
Translation of International Preliminary Report on Patentability for PCT/EP2009/006266, dated Nov. 10, 2010.

* cited by examiner

*Primary Examiner* — Mark Eashoo
*Assistant Examiner* — M. Reza Asdjodi
(74) *Attorney, Agent, or Firm* — Tod A. Waldrop

(57) ABSTRACT

A gel surfactant composition suitable for hard surface cleaning, washing clothes and dishes, and which can be employed for household, institutional and/or industrial applications, composed by water and a) nonionic surfactants in the range of 1 to 50%, b) a cationic surfactant or association of cationic surfactants in the range of 20 to 50% and c) optionally amphoteric surfactants.

13 Claims, No Drawings

GEL SURFACTANT COMPOSITION

This invention relates to a gel surfactant composition suitable for cleaning hard surfaces, washing clothes and dishes, and softening fabrics, and which can be employed for household, institutional and/or industrial applications.

Modern cleaners and detergents must satisfy high requirements: they must have good detergency toward soiling and grease, good appearance, appropriate viscosity, be environmentally compatible and not leave residues on the surfaces. Moreover, they must be very easy to use, reducing time and efforts when performing a washing or cleaning task.

This invention brings up a new option that besides being an extremely efficient cleaner and/or detergent is also very easy to use, presenting a novel way to deliver high performance.

Detergents and cleaning agents are commonly presented in spray-dried or granulated products and/or as liquid forms, but following the new tendencies of the growing premium segment and the desire of the consumer for others possibilities of a comfortable dosage, the search for new formats for detergent and cleaning agents has significantly increased during the last times. Thus tablets and other alternative formats are the aim of many studies, either in the production process development and improvement or the development of new compositions and formulations. Such tablets are usually manufactured from the same ingredients as the known powders or granules, with the addition of tabletting aids and afterwards finalized using some compressing process or by the thickening/hardening of a gel, generally containing only the surfactant system, or even by the encapsulating of the surfactant system by polymers such as PVOH (polyvinyl alcohol). Many tablets available either for dishwashing, cleaners or for laundry detergents, which will be called hereafter as cleaning tablets, are composed by 2 phases, as known by the hard phase (powder compressed) and the smooth phase (gel thickened/surfactant). For example WO 01/42416 describes the production of multi-phase moulded bodies comprising a combination of core molded bodies and a particulate premix.

WO 99/24549 describes a detergent tablet comprising a compressed solid body and a non-compressed gelatinous portion mounted in a mold of said body.

It is an object of the present invention to provide a gel surfactant composition suitable for cleaning hard surfaces, washing clothes and dishes, and softening fabrics, and which can be employed for household, institutional and/or industrial applications.

This invention concerns a gel material obtained by the association of $C_8$-$C_{22}$-alkyl- or $C_8$-$C_{22}$-alkenyl-dimethyl-hydroxy-ethyl ammonium compound and nonionics, especially fatty alcohol ethoxylated from 3 EO to 30 EO degrees, in determined ratios and without the necessity of any thickener or hardener system addition.

The gel aspect is generated by the cationic:nonionic association and can find possible applications in cleaners, disinfectant vehicles, laundry detergent and softener products. This property dispense highly precise and costly process for detergent manufacturers for the production of detergent tablets, toilet block, gel detergents and congeners. Also, this property dispense the usage of a thickener or hardener system, typically a polymeric gelling additive e.g. polyvinylpyrrolidone, polyvinyl alcohol, hydroxystearic acid and polyacetic acid. Moreover, esthetically, this material aspect allows the detergent producer to develop innovative designs which are attractive to a consumer and offers different format alternatives. Most of described tablets relates a dependency of the mechanical strength/material hardness with the dissolution time. As an advantage, this behavior is not observed in the present invention.

The gel material generated by these associations can be described as tablets, blocks, briquettes, rings and such things and the dissolution time will define its final application, that is, the same cationic:nonionic ratio can be used as a toilet block (high dissolution time) or for a "homemade" cleaner and/or disinfectant which can be dissolved by housekeepers which should have a fast dissolution time. The dissolution time is directly affected by the additive used and is totally correlated to the cationic:nonionic ratio used.

In EP 1 162 254 cleaner compositions are disclosed which consist of water, nonionic surfactant and cationic compounds. The content of nonionic surfactant is from 0.1 to 40% and the content of cationic compound is from 0.1 to 30%. These compositions are taught to be of liquid nature. It has now been found that these compositions are of gel nature when the individual amounts of nonionic and cationic compounds are selected as specified below.

The invention provides gel surfactant compositions that are suitable for cleaning hard surfaces such as plastic, vitreous, metal and glass. It is also suitable for washing clothes and dishes. In general the gel surfactant compositions comprise an aqueous composition containing water, 1.0 to 50% by weight of one or more nonionic surfactants, 20 to 50% by weight of one or more cationic compounds selected from $C_8$-$C_{22}$-alkyl- or $C_8$-$C_{22}$-alkenyl-dimethyl-hydroxy-ethyl ammonium compounds, and optionally amphoteric surfactants.

Particularly preferred are inventive gel surfactant compositions with high viscosities, i.e. viscosities of 10000 mPa·s or more at 20° C. and preferably of 20000 mPa·s or more at 20° C. (Brookfield Viscosimeter RV; Spindle No. 7; 20 r.p.m.). Especially preferred inventive gel surfactant compositions exhibit no flow when in the steady-state.

It was found that the combination of hydroxyethyl quats with non-ionic surfactants results in homogenous gels with surprisingly high viscosity. The structure of the non-ionic surfactant and the ratio used in combination with the hydroxyethyl quats influences the hardness of the gel, water solubility and temperature sensitivity, thus enabling the formulation of detergent gel tablets with tailor-made release effects. Those gel surfactant compositions are suitable for cleaning hard surfaces, washing clothes and dishes, softening fabrics, and can be employed for household, institutional and industrial applications.

In a preferred embodiment of the invention, the compositions comprise 10% by weight or more of water, more preferred 20% by weight or more of water, especially preferred 30% by weight or more of water.

In a further preferred embodiment of the invention, the compositions comprise 10-79% by weight of water, more preferred 20-79% by weight of water, especially preferred 30-79% by weight of water.

The nonionic synthetic organic detergents which are employed in the described compositions are generally the condensation product of an organic aliphatic or alkyl aromatic hydrophobic compound, either saturated or unsaturated, containing a terminal hydroxyl group and hydrophilic ethylene/propylene oxide groups. Such detergents are prepared readily by condensing the hydrophobic organic compound with ethylene/propylene oxide or with the polyhydration product thereof, polyethylene/polypropylene glycol. Further, the length of the polyethenoxy/polypropenoxy chain can be adjusted to achieve the desired balance between the hydrophobic and hydrophilic elements.

The satisfactory nonionic detergents include the condensation products of a higher alkanol containing about 8 to 18 carbon atoms, saturated or unsaturated, in a straight- or branched-chain configuration condensed with about 3 to 30 moles, preferably from 3 to 15 moles and even more preferably from 3 to 10 moles, of ethylene/propylene oxide. Examples of these detergents are the condensates of a dodecyl, tridecyl, tetradecyl, hexadecyl alkanol and mixtures thereof with from 3 to 30 moles of ethylene oxide, e.g., condensates of $C_9$-$C_{11}$ alkanol with 5.7 moles of ethylene oxide, condensates of $C_8$-$C_{10}$ alkanol with 5 moles of ethylene oxide, condensates of $C_{10}$-$C_{14}$ alkanol with 16 moles of ethylene oxide and condensates of $C_{10}$-$C_{18}$ alkanol with 20 moles of ethylene oxide.

Other satisfactory nonionic detergents are the polyethylene/polypropylene oxide condensates of one mole of alkyl phenol containing from about 6 to 15 carbon atoms, saturated or unsaturated, in a straight- or branched-chain configuration with about 3 to 30 moles, preferably from 3 to 15 moles and even more preferably from 3 to 10 moles, of ethylene/propylene oxide. Specific examples are nonyl phenol condensed with 9 moles of ethylene oxide, nonyl phenol condensed with 12 moles of ethylene oxide, dodecyl phenol condensed with 15 moles of ethylene oxide and dinonyl phenol condensed with 15 moles of ethylene oxide. Further suitable detergents are the water-soluble condensation products of $C_8$-$C_{18}$ alkanols with a heteric mixture of ethylene oxide and propylene oxide in a weight ratio of ethylene oxide to propylene oxide in the range of 5:1 to 1:5 with the total alkylene oxide content being 60-85% by weight of the molecule. Specific examples of such detergents are $C_9$-$C_{11}$ alkanol condensed with a mixture of 5 moles of ethylene oxide and 4 moles of propylene oxide, $C_9$-$C_{11}$ alkanol condensed with 3 moles of ethylene oxide and 2 moles of propylene oxide and the condensation product of $C_9$-$C_{11}$ alkanol with a mixture of 4 moles of ethylene oxide and 5 mols of propylene oxide.

Other nonionic detergents may be alkyldimethyl-amineoxide, di-alkyl-methylamineoxide, alkylamidopropyl-amine oxide, fatty acid-N-methylglucamide, alkylpolyglucoside, oxalkylated fatty acid, oxalkylated fatty acid ester and oxalkylated alkylamine. The alkyl and fatty acid groups of these compounds, which also may be fully or partially replaced by the corresponding unsaturated groups, may contain 8 to 22 carbon atoms and may be linear or branched. Oxalkylated means products that contain preferably 1 to 20 units of ethylene oxide or propyleneoxide or mixtures thereof.

The amount of nonionic surfactant or mixture of nonionic surfactants in the claimed compositions is from 1.0 to 50% by weight and preferably from 5 to 50% by weight. Also 1.0 to 40% or 40.1 to 50% by weight of nonionic surfactant can be used.

As cationic surfactants there may be used alkyldimethyl-hydroxyethyl-ammonium. Instead of alkyl these ammonium compounds may also have alkenyl groups or mixtures of both. The alkyl as well as the alkenyl groups may contain 8 to 22 carbon atoms. They may be linear or branched. Preferred ammonium compounds are $C_8$-$C_{22}$-alkyl- or alkenyl-dimethyl-hydroxyethyl-ammonium compounds. Particularly preferred ammonium compounds are $C_{12}$/$C_{14}$-alkyl dimethyl hydroxyethyl ammonium compounds. All mentioned ammonium compounds may contain any kind of anion, the preferred ones are chloride, bromine, acetate, lactate, sulfate or methosulfate. A very preferred ammonium compound is $C_{12}$/$C_{14}$-alkyl dimethyl hydroxyethyl ammonium chloride.

The claimed compositions may contain these cationic compounds in an amount from 20 to 50% by weight and preferably from 20 to 40% by weight. Also 20 to 30% or 30.1 to 50% by weight of these cationic compounds can be used.

Furthermore, the compositions according to the invention may contain 0.1 to 20, preferably 0.2 to 15% by weight of amphoteric surfactants. The amphoteric surfactants may be alkyl amidopropyl betaines, alkyl dimethyl betaines, alkyl amphoacetates or -diacetates. The alkyl groups of these compounds, which may be partially or fully replaced by alkenyl groups, may contain 8 to 22 carbon atoms and may be linear or branched. The polyalkylene glycol groups may contain 1 to 20 ethoxy and/or propoxy units.

Depending on the intended use, the formulations according to the invention may comprise, in addition to said surfactants, additives and auxiliaries which are customary and specific in each case, for example additives for dissolution time control, additives for performance improvement, solvents, builders or salts.

Suitable additives for dissolution time control are glycerin, sugar, propyleneglycol, butylglycol, di-butylglycol, ethyleneglycol, mono-, di-, tri-, or tetra-$C_2$-$C_5$ alkylene glycol-propyleneglycol, isopropanol, ethanol, PEG—having molecular weights of at least 400, PEGs of molecular weight ranging from 6000 to 35000 are most preferred, and mixture thereof.

Suitable additives for performance improvement include soil release polymers, dye fixatives, bleach systems, biocides or builders. Suitable soil release polymers are copolymers of acrylic acid and maleic acid (Sokalan® CP—BASF), Homo- and copolymers of vinylpyrrolidone, vinylimidazole and nonionic monomers (Sokalan HP—BASF), Homopolymers of acrylic acid (Sokalan® PA—BASF), Polyethylene Terephthalate (PET) and Polyoxyethylene Terephthalate (POET) (Texcare® SRN—Clariant), Soil release polymers which can be used are, for example, cellulose ethers or polycondensates based on dibasic carboxylic acids and reactants which possess two or more hydroxyl groups. The dibasic carboxylic acid used is typically terephthalic acid. These soil release polymers may be nonionic or anionic.

The dye fixatives which can be incorporated into inventive compositions are nonionic or cationic and are described below:

Polycondensates which can be used as dye fixatives are obtained by the reaction of cyanamides with aldehydes and ammonium salts and/or monoamines (e.g. dye fixative DF3), by the reaction of monoamines and/or polyamines with epichlorohydrin (e.g. dye fixatives DF2 and DF4) or by the reaction of polyamines with cyanamides and amidosulfuric acid (e.g. dye fixative DF1).

The monoamines used may be primary, secondary and tertiary amines. They may be aliphatic amines, for example dialkylamines, especially dimethylamine, alicyclic amines, for example cyclohexylamine, and aromatic amines, for example aniline. However, the amines used may also simultaneously have aliphatic, alicyclic and aromatic substituents. In addition, it is also possible to use heterocyclic compounds, for example pyridine.

The term "polyamines" here includes, for example diamines, triamines, tetraamines, etc, and also the analogous N-alkylpolyamines and N,N-dialkylpolyamines. Examples thereof are ethylenediamine, propylenediamine, butylenediamine, pentylenediamine, hexylenediamine, diethylenetriamine, triethylenetetraamine and higher polyamines. Particularly preferred polyamines are ethylenediamine, diethylenetriamine and dimethylaminopropylamine. The ammonium salts are salts of ammonia, especially ammonium chloride or the abovementioned amines or polyamines with different inorganic or organic acids, or else quaternary ammonium salts.

The cyanamides may be cyanamide or dicyandiamide.

Aldehydes which can be used for the synthesis of the dye fixatives are, for example, aliphatic aldehydes, for example formaldehyde, acetaldehyde, propionaldehyde, butyraldehyde; dialdehydes, for example glyoxal; unsaturated aldehydes, for example acrolein, crotonaldehyde and aromatic aldehydes, for example benzaldehyde. Particular preference is given to the aliphatic aldehydes, especially formaldehyde.

The dye fixatives used may also be homo- and copolymers based on diallyldimethylammonium chloride (DADMAC) (e.g. dye fixatives DF5, DF6 and DF7).

Copolymers based on DADMAC contain, as further components, other vinylic monomers, for example vinylimidazole, vinylpyrrolidone, vinyl alcohol, vinyl acetate, (meth) acrylic acid/ester, acrylamide, styrene, styrenesulfonic acid, acrylamidomethylpropanesulfonic acid (AMPS), etc. Homopolymers based on DADMAC are obtainable under the trade names Dodigen® 3954, Dodigen® 4033 and Genamin PDAC (from Clariant).

Bleach systems such as inorganic peroxygen compounds, especially hydrogen peroxide and solid peroxygen compounds which dissolve releasing hydrogen peroxide in water, such as sodium perborate and sodium carbonate perhydrate and mixtures thereof; and bleach activators, such as those from the substance classes of the N- or O-acyl compounds, for example polyacylated alkylenediamines, especially tetraacetylethylene-diamine and tetraacetylglycoluril, N-acylated hydantoins, hydrazides, triazoles, hydrotriazines, urazoles, diketopiperazines, sulfurylamides and cyanurates, and also carboxylic anhydrides, especially phthalic anhydride and substituted maleic anhydrides, carboxylic esters, especially sodium acetoxybenzenesulfonate, sodium benzoyloxybenzenesulfonate (BOBS), sodium nonanoyloxybenzenesulfonate (NOBS), sodium isononanoyloxybenzenesulfonate (ISONOBS), and acylated sugar derivatives such as pentaacetylglucose, and mixtures thereof.

Biocides are any known ingredient having the ability of reducing or eliminating by killing or removing the microorganisms existing on a surface. Biocide useful herein includes Alcohols, Aldehydes, Formaldehyde releasing compounds, Phenolics, Acid esters Carbamates, Amides, Dibenzamidines, Pyridine Derivatives and related compounds, Azoles, Heterocyclic N,S Compounds, N haloalkylthio compounds, Compounds with activated Halogen Atoms, Surface Active Agentes, Organometallic Compounds, Thiocyanates, Biphenyl, Triazine, oxidizing agents and mixtures thereof.

Suitable organic and inorganic builders are neutral or, in particular, alkaline salts which are able to precipitate out calcium ions or bind calcium ions to form a complex. Suitable and particularly ecologically acceptable builder substances, such as finely crystalline, synthetic hydrous zeolites preferably the type NaA, which have a calcium-binding capacity in the range from 100 to 200 mg of CaO/g, are used in preference. Zeolite and phyllosilicates can be present in the composition in an amount up to 20% by weight. Organic builders which can be used are, for example, the group consisting of amino carboxylic acid, organo aminophosphonic acid compounds, and mixture thereof. Those components, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Suitable components for use herein include the amino carboxylic acids such as ethylenediamine-N,N'-disuccinic acid (EDDS), ethylenediamine tetraacetic acid (EDTA), N-hydroxyethylenediamine triacetic acid, nitrilotriacetic acid (NTA), ethylene diamine tetrapropionic acid, ethylenediamine-N,N'-diglutamic acid, 2-hydroxypropylenediamine-N,N'-disuccinic acid, triethylenetetraamine hexacetic acid, diethylenetriamine pentaacetic acid (DETPA), trans 1,2 diaminocyclohexane-N,N,N',N'-tetraacetic acid or ethanoldiglycine. Other suitable components for use herein include the organo aminophosphonic acids such as ethylenediamine tetrakis (methylenephosphonic acid), diethylene triamine-N,N,N',N",N"-pentakis (methylene phosphonic acid) (DETMP), 1-hydroxyethane 1,1-diphosphonic acid (HEDP) or hydroxyethane dimethylenephosphonic acid. It is also possible to use polymeric carboxylates and salts thereof. These include, for example, the salts of homopolymeric or copolymeric polyacrylates, polymethylacrylates and in particular, copolymers of acrylic acid with maleic acid, and also polyvinylpyrrolidone and urethanes. The relative molecular mass of the homopolymers is generally between 1000 and 100,000, that of the copolymers is between 2000 and 200,000, preferably 50,000 to 120,000, based on the free acid, in particular water-soluble polyacrylates which have been crosslinked, for example, with approximately 1% of a sugar polyallyl ether and which have a relative molecular mass above one million are also suitable. Examples thereof are the polymers obtainable under the name Carbopol® 940 and 941.

In a further preferred embodiment of the invention the inventive compositions additionally contain one or more solvents, preferentially lower alkyl ethers of ethylenglycol, propylenglycol, polyethylenglycol and polypropylenglycol. "Lower alkyl" preferably means alkyl groups with 1 to 4 carbon atoms.

In general, additionally present in small use concentrations are additive constituents which can be summarized under the term "washing assistants" and which thus include different active substance groups such as for example enzymes, especially proteases, lipases, cellulases, amylases and mannanases; enzyme stabilizers; preservatives; foam enhancers; foam inhibitors such as silicone oils or paraffins; corrosion inhibitors; optical brighteners; pearlizing agents; UV absorbers; alkalis; hydrotropic compounds; antioxidants; solvents; extenders dispersants; graying inhibitors; softeners; antistats; dyes and perfumes.

Suitable enzymes are those from the class of proteases, lipases, amylases and their mixture. Their proportion can be from 0.2 to 1% by weight. The enzymes can be adsorbed to carrier substances and/or embedded into coating substances.

Suitable preservatives are, for example, phenoxyethanol, formaldehyde solution, pentanediol or sorbic acid.

Suitable pearlizing agents are, for example, glycerol distearic esters such as ethylene glycol distearate, but also fatty acid monoglycol esters.

Suitable salts or extenders are, for example, sodium chloride, sodium sulfate, sodium carbonate, sodium silicate (water glass), magnesium chloride, or magnesium sulfate.

In a further preferred embodiment of the invention the gel surfactant compositions consist of water, the non-ionic surfactants and the $C_8$-$C_{22}$-alkyl- or $C_8$-$C_{22}$-alkenyl-dimethyl-hydroxy-ethyl ammonium compounds.

The products according to the invention are notable for very good storage stability and also detergency. The claimed compositions are in a gel form and preferably as a tablet.

The inventive gel surfactant compositions are preferably transparent.

The examples below serve to illustrate the invention in more detail without limiting it thereto. All amounts are given as % (w/w).

EXAMPLES

1. A) 30% $C_{12}/C_{14}$-alkyldimethyl hydroxyethyl ammonium chloride
   B) 25% oleyl alcohol with 10 moles of ethylene oxide
   C) water at 100%

Aspect: transparent, high viscous gel

2. A) 28% $C_{12}/C_{14}$-alkyl dimethyl hydroxyethyl ammonium chloride
   B) 30% miristyl alcohol with 5 moles of ethylene oxide
   C) water at 100%
3. A) 24% $C_{12}/C_{14}$-alkyl dimethyl hydroxyethyl ammonium chloride
   B) 40% lauryl alcohol with 20 moles of ethylene oxide
   C) 1.0% performance additive
   D) water at 100%
4. A) 35% $C_{12}/C_{14}$-alkyl dimethyl hydroxyethyl ammonium chloride
   B) 12.5% stearyl alcohol with 15 moles of ethylene oxide
   C) water at 100%
5. A) 35% $C_{12}/C_{14}$-alkyl dimethyl hydroxyethyl ammonium chloride
   B) 5% cetyl alcohol with 10 moles of ethylene oxide
   C) 5% coconut alcohol with 12 moles of ethylene oxide
   D) 1.0% dye fixing agent
   E) water at 100%
6. A) 38% $C_{12}/C_{14}$-alkyl dimethyl hydroxyethyl ammonium chloride
   B) 5% coconut alcohol with 12 moles of ethylene oxide
   C) water at 100%
7. A) 23% $C_{12}/C_{14}$-alkyl dimethyl hydroxyethyl ammonium chloride
   B) 42.5% oleyl alcohol with 15 moles of ethylene oxide
   C) 1.0% sodium chloride
   D) water at 100%
8. A) 22% $C_{12}/C_{14}$-alkyl dimethyl hydroxyethyl ammonium chloride
   B) 38% cetyl alcohol with 9 moles of ethylene oxide
   C) 7% stearyl alcohol with 9 moles of ethylene oxide
   D) water at 100%
9. A) 20% $C_{12}/C_{14}$-alkyl dimethyl hydroxyethyl ammonium chloride
   B) 50% coconut alcohol with 7 moles of ethylene oxide
   C) water at 100%
10. A) 30% $C_{12}/C_{14}$-alkyldimethyl hydroxyethyl ammonium chloride
   B) 50% oleyl alcohol with 10 moles of ethylene oxide
   C) water 20%

Aspect: transparent, high viscous gel

The compositions, 1 to 10 have been prepared in the following way: The nonionic components were heated to 35-40° C. and then added to the aqueous solution of quaternary ammonium compound. Subsequently the additive—when required—was added at 35-40° C. This mixture was heated to 80-85° C. and stirred at this temperature until homogenization was completed. Finally the composition was put in a proper mold and cooled to room temperature. All the compositions as shown in these examples are of gel nature.

Comparative Example A

A) 40.5% $C_{12.5}$-alkyldimethyl hydroxyethyl ammonium stearate
B) 59.5% $C_{14-15}$ primary alcohol with 7 moles of ethylene oxide
C) water 0%

Aspect: white, inhomogeneous waxy solid, not transparent and no gel

Comparative Example B

A) 40.5% $C_{12}/C_{14}$-alkyl dimethyl hydroxyethyl ammonium chloride
B) 59.5% oleyl alcohol with 10 moles of ethylene oxide
C) water 0%

Aspect: white waxy, inhomogeneous solid, not transparent and no gel

Comparative Examples A and B have been prepared in the following way: The nonionic components were heated to 35-40° C. and then added to the quaternary ammonium compound. This mixture was heated to 80-85° C. and stirred at this temperature for 1 hour. Finally the composition was put in a proper mold and cooled to room temperature.

The invention claimed is:

1. A gel surfactant composition comprising water in an amount of 20% to 79% by weight, 1 to 50% by weight of at least one nonionic surfactant, wherein the nonionic surfactant is a condensation product of a $C_8$-$C_{18}$-alkanol with 3 to 30 moles of ethylene/propylene oxide or a condensation product of one mole of alkyl phenol containing from 6 to 15 carbon atoms with 3 to 30 moles of ethylene/propylene oxide, or a mixture thereof, and 20 to 50% by weight of cationic compounds selected from the group consisting of $C_8$-$C_{22}$-alkyl- and $C_8$-$C_{22}$-alkenyl-dimethyl-hydroxy-ethyl ammonium compounds, wherein the composition exhibits no flow when in the steady-state.

2. A composition as claimed in claim 1, wherein the at least one nonionic surfactant is present in an amount of from 1 to 40% by weight.

3. A composition as claimed in claim 1, wherein the at least one nonionic surfactant is present in an amount of from 40.1 to 50% by weight.

4. A composition as claimed in claim 1, wherein the cationic compound is present in an amount of from 20 to 30% by weight.

5. A composition as claimed in claim 1, wherein the cationic compound is present in an amount of from 30.1 to 50% by weight.

6. A composition as claimed in claim 1, further comprising from 0.1 to 20% by weight of at least one amphoteric surfactant.

7. A composition as claimed in claim 1, further comprising additives and adjuvants.

8. A composition as claimed in claim 1, further comprising at least one solvent.

9. A composition as claimed in claim 1, wherein the composition consists of water, at least one non-ionic surfactant and $C_8$-$C_{22}$-alkyl- or $C_8$-$C_{22}$-alkenyl-dimethyl-hydroxyethyl ammonium compounds.

10. A composition as claimed in claim 1, wherein the composition is transparent.

11. A composition as claimed in claim 1, wherein the nonionic surfactant is a condensation product of a $C_8$-$C_{18}$-alkanol with 3 to 15 moles, of ethylene/propylene oxide or a condensation product of one mole of alkyl phenol containing from 6 to 15 carbon atoms with 3 to 15 moles of ethylene/propylene oxide, or a mixture thereof.

12. A composition as claimed in claim 1, wherein the nonionic surfactant is a condensation product of a $C_8$-$C_{18}$-alkanol with 3 to 10 moles, of ethylene/propylene oxide or a condensation product of one mole of alkyl phenol containing from 6 to 15 carbon atoms with 3 to 10 moles of ethylene/propylene oxide, or a mixture thereof.

13. A composition as claimed in claim 1, further comprising at least one solvent selected from the group consisting of the lower alkyl ethers of ethylenglycol, propylenglycol, polyethylenglycol and polypropylenglycol.

* * * * *